US006761159B1

(12) United States Patent
Barnes et al.

(10) Patent No.: US 6,761,159 B1
(45) Date of Patent: Jul. 13, 2004

(54) EXHAUST COOLING SYSTEM FOR A COOKING APPLIANCE

(75) Inventors: Shelton T. Barnes, Chattanooga, TN (US); Eddie Max Brock, Cleveland, TN (US); Christopher A. Larsen, Dorchester, MA (US); Gerald R. Place, East Ridge, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,606

(22) Filed: Mar. 12, 2003

(51) Int. Cl.[7] ..... A21B 1/00
(52) U.S. Cl. ..... 126/21 R; 126/15 R; 219/757
(58) Field of Search ..... 126/21 R, 21 A, 126/15 R, 15 A, 273 R; 219/756, 757, 400

(56) References Cited

U.S. PATENT DOCUMENTS

| | | | | |
|---|---|---|---|---|
| 2,743,719 A | | 5/1956 | Reeves | |
| 2,839,044 A | | 6/1958 | Phares | |
| 3,057,341 A | | 10/1962 | Perl | |
| 3,255,746 A | | 6/1966 | Jenn et al. | |
| 3,270,736 A | | 9/1966 | Barnett | |
| 3,499,430 A | | 3/1970 | Kemp | |
| 3,633,561 A | | 1/1972 | Barnett et al. | |
| 3,659,578 A | | 5/1972 | Davis et al. | |
| 3,889,099 A | | 6/1975 | Nuss | |
| 3,924,601 A | | 12/1975 | Nuss | |
| 3,939,817 A | | 2/1976 | Nuss | |
| 3,962,561 A | | 6/1976 | Maitenaz | |
| 4,163,894 A | | 8/1979 | Scherer | |
| 4,373,504 A | | 2/1983 | Day | |
| 4,375,213 A | * | 3/1983 | Kemp et al. | 126/21 A |
| 4,392,038 A | | 7/1983 | Day et al. | |
| 4,418,615 A | * | 12/1983 | Higgins | 99/331 |
| 4,430,541 A | | 2/1984 | Day, Jr. | |
| 4,431,889 A | | 2/1984 | Saponara et al. | |
| 4,598,689 A | * | 7/1986 | Eke | 126/21 A |
| 4,598,691 A | | 7/1986 | Herrelko et al. | |
| 4,601,279 A | | 7/1986 | Guerin | |
| 4,716,884 A | | 1/1988 | Bonaccorsi et al. | |
| 4,763,638 A | | 8/1988 | Hurley et al. | |
| 4,796,600 A | * | 1/1989 | Hurley et al. | 126/273 A |
| 4,865,010 A | | 9/1989 | Kett | |
| 5,158,065 A | | 10/1992 | Lee et al. | |
| 5,738,081 A | | 4/1998 | Puricelli | |
| 6,098,613 A | * | 8/2000 | Wiersma | 126/273 R |
| 6,172,338 B1 | | 1/2001 | Barnes et al. | |
| 6,234,161 B1 | | 5/2001 | Levi et al. | |

FOREIGN PATENT DOCUMENTS

| | | |
|---|---|---|
| DE | 4124922 | 1/1993 |
| EP | 337962 | 10/1989 |

* cited by examiner

*Primary Examiner*—Jiping Lu
(74) *Attorney, Agent, or Firm*—Diederiks & Whitelaw, PLC

(57) ABSTRACT

A cook appliance in the form of a range having upper and lower oven is provided with an exhaust system including an exhaust duct for the lower oven which extends through an exhaust duct for the upper oven. Each of the exhaust ducts leads to an exhaust air box which defines an exhaust outlet for the appliance. Preferably, the exhaust duct for the lower oven has associated therewith an extension sleeve which divides the exhaust air box into separate exhaust zones for the upper and lower ovens. Provisions are made to dilute and/or cool exhaust gases flowing through the ducts prior to the exhaust gases existing the appliance.

34 Claims, 5 Drawing Sheets

EXHAUST COOLING SYSTEM FOR A COOKING APPLIANCE

BACKGROUND OF THE INVENTION

1. Field of the Invention

The present invention pertains to the art of cooking appliances and, more particularly, to a system for exhausting a plurality of oven cavities arranged within a cooking appliance.

2. Discussion of the Prior Art

In general, provisions must be made in a cooking appliance for exhausting cooking gases and other byproducts generated in an oven cavity during cooking operations. Often, an oven cavity of a range will be exhausted from beneath a rear one of a plurality of surface heating elements. In other known arrangements, the oven cavity will be vented along a rear control panel. Obviously, due to operation of the oven cavity, the exhaust can have a significant amount of heat. To this end, it is fairly well known to provide a system to cool a domestic oven or the like to prevent the oven gases from escaping to the surrounding environment at too high of a temperature, and especially from impinging upon oven control components arranged in proximity to an exhaust outlet. More specifically, the high temperature exhaust, when caused to flow over the control components, can warp, discolor, and otherwise damage both the aesthetics and operational capabilities of the control components.

Prior art oven arrangements have typically relied upon forced air cooling systems for controlling internal oven temperatures. Such forced air systems have also been used to protect various controls and instruments present in typical oven arrangements. However, all such forced air systems have particular cost and reliability concerns. Specifically, the fan, its motor, and associated control elements add to the expense of the overall appliance and, often times, represent other reliability concerns.

Other prior art systems control the exhaust airflow temperature by combining an incoming or ambient airflow with the exhaust airflow.

Typically, such systems often add the ambient airflow at or near to the oven cavity. Unfortunately, with such an arrangement, the overall cooling effect derived from the ambient airflow on the exhaust gases is minimal. Still other prior art systems do not attempt to employ a cooling system, but rather rely upon mitigating the effects of the exhaust airflow by simply diverting the escaping exhaust gases away from oven control elements.

Based on the above, there exists a need in the art for an improved cooling system for a cooking appliance. As many of the described problems are exacerbated in cooking appliances including multiple ovens, there exists a particular need for a system which can effectively exhaust gases from a dual oven cooking appliance. In addition, there exists a need for an efficient and compact exhaust system which relies upon natural convection.

SUMMARY OF THE INVENTION

In accordance with the present invention, a cooking appliance includes a cabinet, generally defined by upper rear, opposing side wall and back panel portions, and first and second oven cavities. Specifically, the oven cavities are spaced from the back panel portion such that a passageway is established between the oven cavities and the back panel. The appliance further includes an exhaust air box having an exhaust opening arranged about the upper rear portion of the cabinet. In a preferred arrangement, a control panel, including a plurality of control elements, is arranged on the upper rear portion, adjacent to the exhaust air box.

In a preferred form of the present invention, first and second exhaust ducts are arranged within the passage to carry, through a process of natural convection, respective first and second exhaust airflows from the first and second oven cavities to the exhaust air box. In a preferred embodiment of the invention, the second duct extends through the first duct. The second duct is extended, such as through the use of an extension sleeve, to directly adjacent exhaust openings of the appliance. Most preferably, the sleeve is positioned in a central zone of the exhaust air box such that the second oven vents out the central zone and the first oven vents out on either side of the central zone. At least the second duct is exposed to a flow of cooling air enabling a certain amount of heat transfer therebetween. In addition, cooling air is also directed about the exhaust air box and exits above the exhaust air box. This airflow establishes a barrier between the hotter exhaust gases and a control panel. An air diverter or deflector is further employed to direct the exhaust gases away from the control panel.

With this arrangement, an effective and economically viable exhaust system is established for a cooking appliance having multiple oven cavities arranged in an overall compact configuration. In any case, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
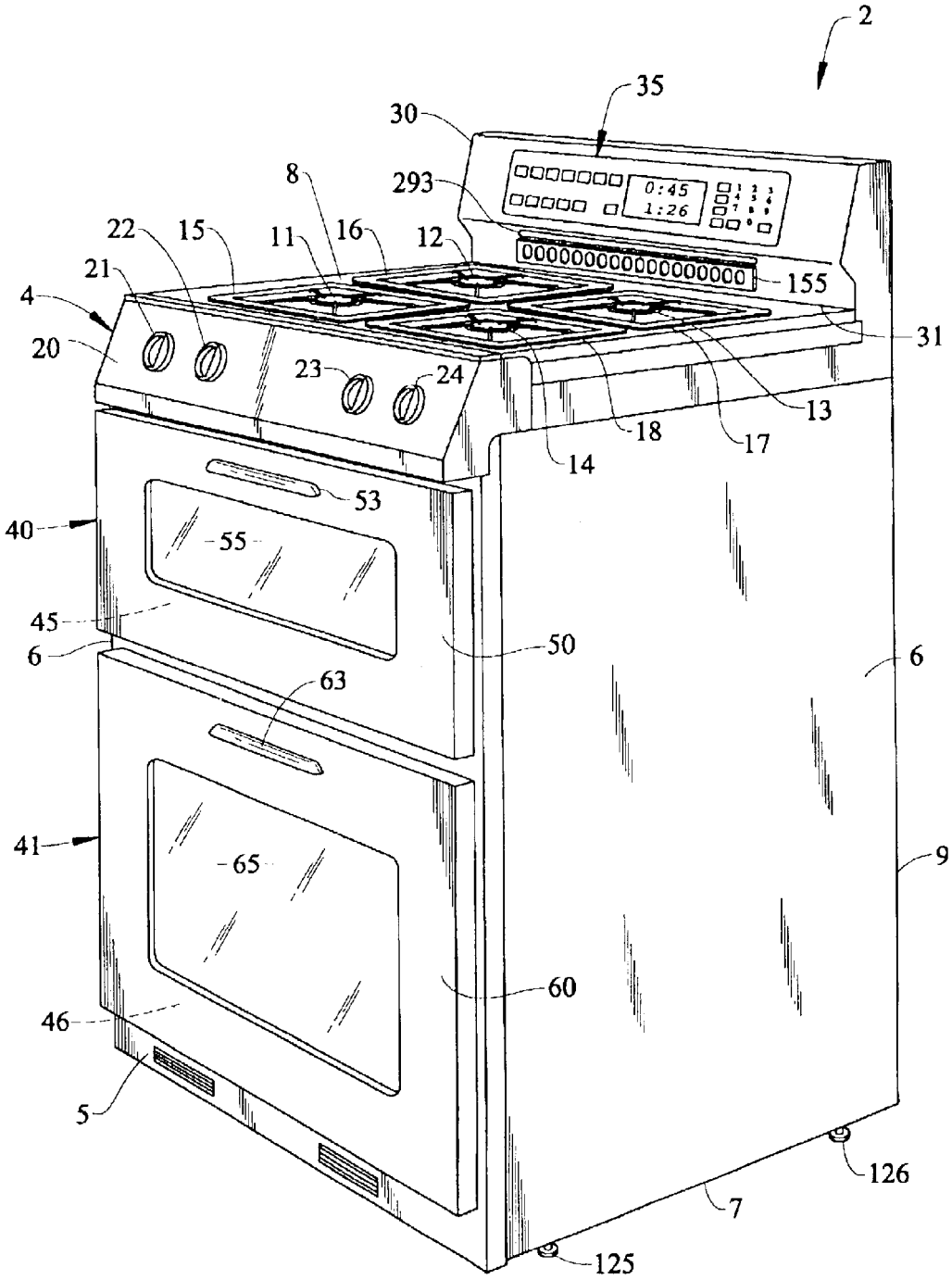
FIG. 1 is an upper right front perspective view of a cooking appliance incorporating the exhaust air cooling system configured in accordance with a preferred embodiment of the present invention.

With initial reference to FIG. 1, the exhaust cooling system of the present invention is preferably incorporated into a cooking appliance generally indicated at 2. As shown, cooking appliance 2 takes the form of a free-standing gas range unit. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with various gas burner elements 11–14 and associated burner grates 15–18. Cabinet 4 further includes a front control surface 20. Preferably, control surface 20 supports a plurality of control knobs 21–24 for controlling the activation/de-activation of gas burners 11–14 respectively. Furthermore, cabinet 4 includes an upstanding control panel 30 arranged at an upper rear portion 31 of cabinet 4. In the embodiment shown, control panel 30 includes a central control and display unit, generally indicated at 35, for use in controlling a first or upper oven 40 and a second or lower oven 41.

In the preferred embodiment, upper oven 40 includes a respective first or upper oven cavity 45 and, similarly, lower oven 41 includes a respective second or lower oven cavity 46. In a manner known in the art, upper oven 40 has associated therewith a door 50 which can be pivoted by means of a handle 53. Door 50 preferably includes a window 55 for viewing the contents of upper oven cavity 45. In a similar manner, lower oven 41 has associated therewith a door 60, a handle 63 and a window 65.

Figure 2:
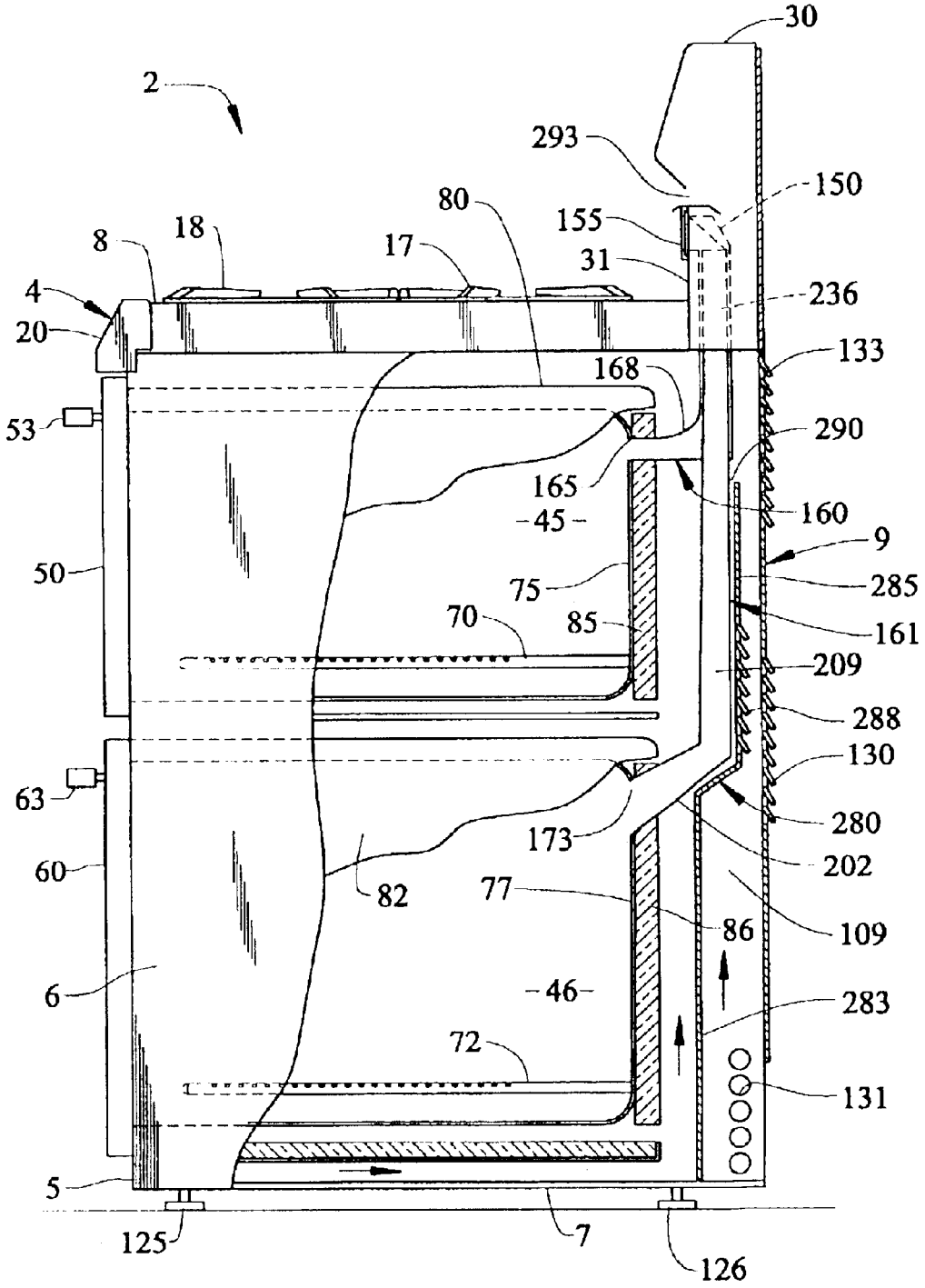
FIG. 2 is a partial, cross-sectional side view of the cooking appliance of FIG. 1.

Referring to FIG. 2, upper and lower oven cavities 45 and 46 have arranged therein a first or upper burner assembly 70 and a second or lower burner assembly 72 respectively. As shown, upper and lower burner assemblies 70 and 72 extend from rear walls 75 and 77 of upper and lower oven cavities 45 and 46. As the particular construction and mounting of burner assemblies 70 and 72 are not considered part of the present invention, they will not be discussed further herein. In order to maintain a heated atmosphere within upper and lower ovens cavities 45 and 46, upper and lower insulation blankets 80 and 82 extend about upper exterior and side portions of upper and lower ovens 40 and 41. Similarly, vertically arranged layers of insulation 85 and 86 are positioned against rear walls 75 and 77, respectively. Main back panel 9 is attached to side panels 6 and , as best shown in FIG. 2, maintained in a spaced relationship from oven cavities 45 and 46 so as to establish a passageway 109 extending from bottom portion 7 to top surface 8.

In a manner known in the art, range 2 is adapted to be mounted upon a supporting surface, such as a kitchen floor or the like. More specifically, a plurality of leg members, two of which are indicated in FIGS. 1 and 2 at 125 and 126, extend from bottom portion 7 at front and rear portions of cabinet 4, along side panel 6. Of course, corresponding leg members 125 and 126 are also provided on the opposing side of range 2. In any event, the various leg members 125 and 126 are preferably vertically adjustable to also act as levelers for range 2. Such type of leg leveler arrangements are widely known in the art of appliances, including both ranges and refrigerators such that the leveling function of leg members 125 and 126 does not form part of the present invention.

As will be detailed more fully below, arranged about back panel 9 are a first plurality of inlet louvered openings 130 which enable an ambient airflow to enter passageway 109. Additional ambient airflow is received through a plurality of vertically spaced holes 131 arranged in a lower rear portion of each side panel portion 6. However, in order to provide sufficient ambient air into passageway 109, back panel 9 includes additional or second inlet openings. In one arrangement, the second inlet openings take the form of louvers 133 which are stamped out of main back panel 9 and lead to passageway 109.

In a manner known in the art, a cooking process is performed by placing a food item into oven 40 or 41, wherein hot oven gases are generated and caused to cook the food item. During the cooking process, a portion of the hot oven gases must be exhausted in order to prevent a pressure build-up within the oven cavity 45, 46. The manner in which cooling and combustion air is introduced into cabinet 4 is disclosed in U.S. patent application entitled "Cooling and Combustion Airflow Supply System for a Gas Range" filed on even date herewith and incorporated herein by reference.

The present invention is particularly directed to an exhaust cooling system for exhausting gases and other cooking byproducts, preferably while lowering the temperature of an exhaust airflow, emanating from either or both of upper and lower oven cavities 45 and 46 during operation of range 2.

Referring to FIG. 2, the exhaust cooling system constructed in accordance with the present invention includes an exhaust air box 150 including an exhaust outlet 155, and first and second exhaust air ducts 160 and 161. As shown, air box 150 is mounted at upper rear portion 31 of cabinet 4, directly below control panel 30. In accordance with a preferred form of the invention, first exhaust air duct 160 includes a first end 170 opening at rear surface 75 of first oven cavity 45 and a main body portion 168 leading to exhaust air box 150 in a manner which will be more fully discussed below. In a similar manner, second exhaust duct 161 includes a first end 173 opening at rear surface 77 of second oven cavity 46 and a main body portion 176 leading to exhaust air box 150.

Figure 4:
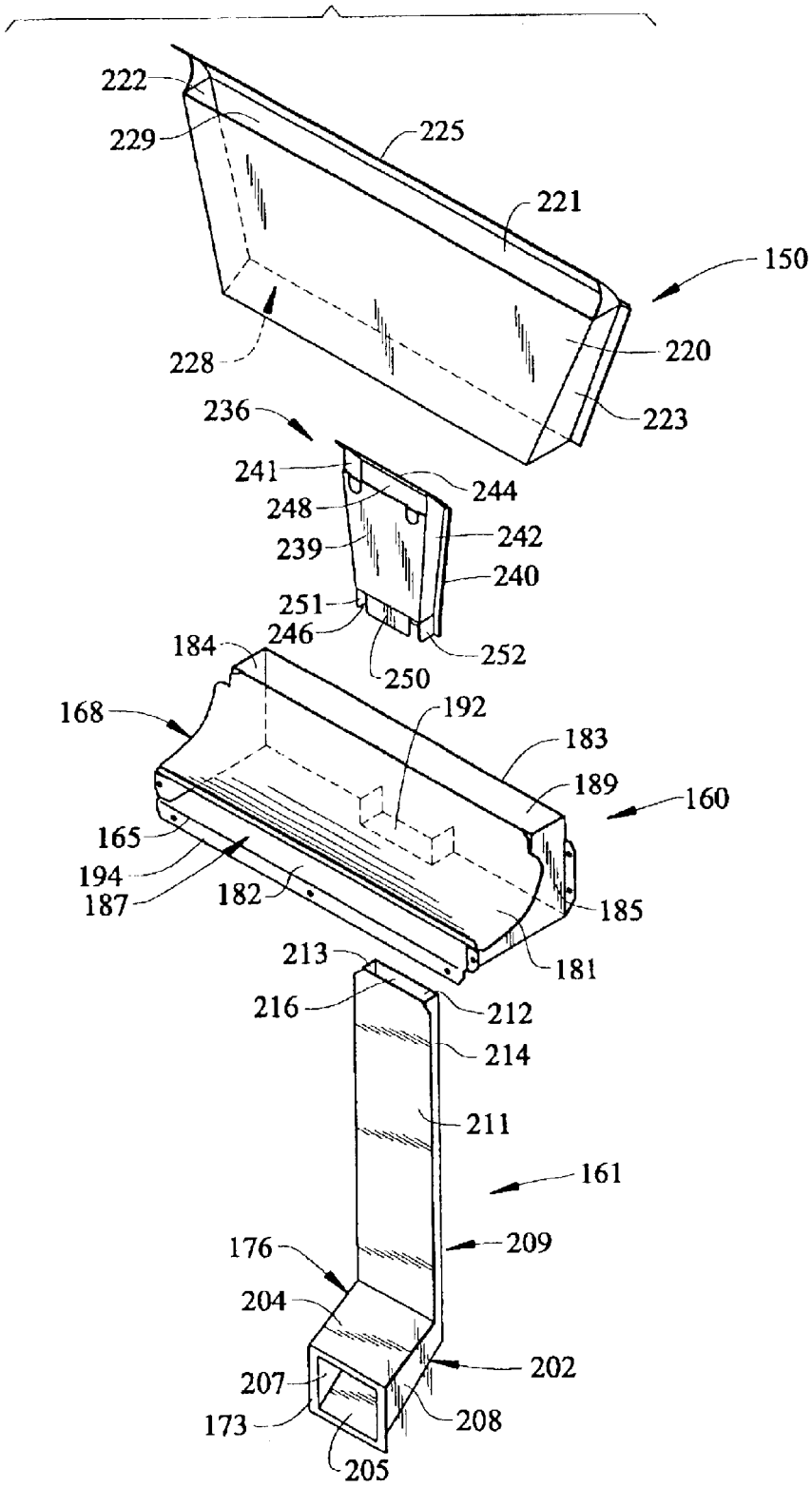
FIG. 4 is an exploded view of an exhaust ducting arrangement employed in connection with the invention.

With particular reference to FIG. 4, first exhaust duct 160 includes an upper wall 181, a bottom wall 182, a rear wall 183 and side walls 184 and 185. In the most preferred form of the invention, upper wall 181 is arcuate in shape and, more specifically, concave. First open end 165 leads to an internal flow channel 187 defined by first exhaust duct 160, with channel 187 having an associated second open end 189. Bottom wall 182 is shown to include a central, rear cut-out 192 at a position spaced from second open end 189. First open end 165 is shown to include a plurality of flanges, one of which is indicated at 194, for securing main body portion 168 to oven cavity 45. With this construction, exhaust gases leaving first oven cavity 45 are directed into first open end 165 and are redirected upwardly within main body portion 168 towards second open end 189, preferably through natural convection.

As also shown in FIG. 4, second exhaust duct 161 includes an upwardly and rearwardly extending body portion 202 having an upper wall 204, lower wall 205 and side walls 207 and 208. In the preferred embodiment shown, body portion 202 tapers rearwardly and upwardly and opens into an upstanding stack portion 209 of main body portion 176. Stack portion 209 is shown to include front, rear and side walls 211–214 respectively. In a manner similar to first exhaust duct 160, second exhaust duct 161 is secured to an upper rear portion of lower oven 41 such that first open end 173 opens into second oven cavity 46, wherein exhaust gases and other byproducts generated during operation of oven 41 are led into second exhaust duct 161 and directed to an open upper end 216. The exact arrangement of second exhaust duct 161 within cabinet 4 will be described below.

Exhaust air box 150 is shown to include a front wall 220, a rear wall 221 and opposing side walls 222 and 223. In accordance with the most preferred form of the invention, rear wall 221 and side walls 222 and 223 are extended to define a hood portion 225 which extends forwardly and upwardly. With this construction, exhaust air box 150 defines a lower open end 228 and an upper open end 229.

Shown between exhaust air box 150 and first exhaust duct 161 in FIG. 4 is an extension sleeve generally indicated at 236. In the preferred embodiment depicted, extension sleeve 236 includes a front wall 239, rear wall 240 and opposing side walls 241 and 242. In a manner generally analogous to exhaust air box 150, rear wall 240 and side walls 241 and 242 preferably lead to a forwardly and upwardly extending portion 244. With this construction, extension sleeve 236 defines an open bottom 246 and an upper frontal opening 248. In the most preferred form of the invention, open bottom 246 has extending thereabout, at front wall 239 and side walls 241 and 242, a plurality of tab elements 250–252 respectively.

Figure 5:
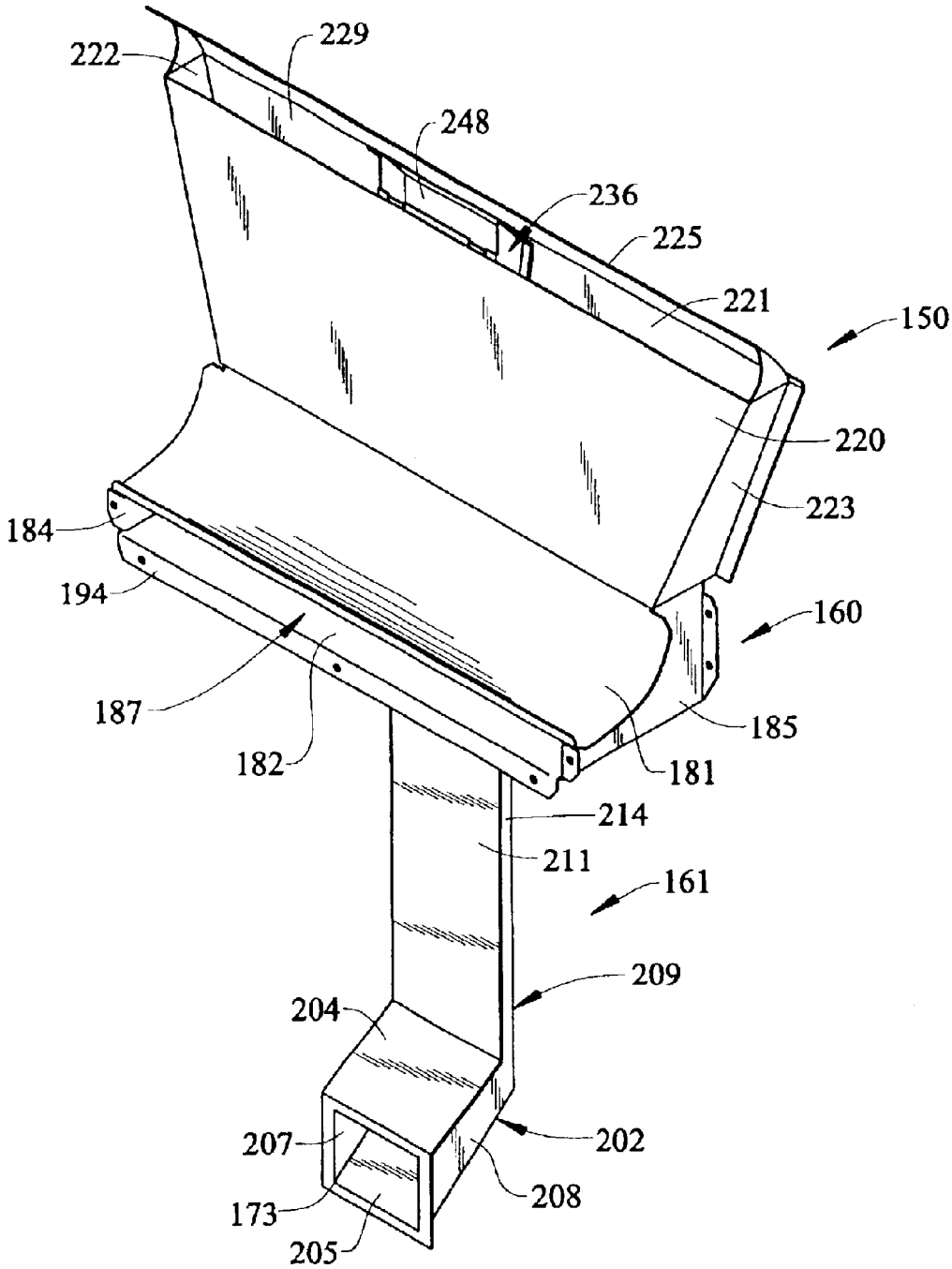
FIG. 5 is an assembled view of the exhaust ducting arrangement of FIG. 4.

As indicated above, first exhaust duct 161 is attached to upper oven 40 and opens into first oven cavity 45, while second exhaust duct 162 is attached to lower oven 41 and opens into second oven cavity 46. More specifically, with particular reference to FIGS. 2, 4 and 5, upstanding stack portion 109 of second exhaust duct 161 extends into cut-out 192 provided in bottom wall 182 of first exhaust duct 161. Received within open upper end 216 are tab elements 250–252, as well as a lowermost portion of rear wall 240 of extension sleeve 236. Therefore, upstanding stack portion 209 projects within a central portion of channel 187 of first exhaust duct 160 and the length thereof is extended by sleeve 236. Extension sleeve 236, on the other hand, is positioned within exhaust air box 150 such that upper frontal opening 248 is centrally disposed at the upper open end 229 of hood portion 225. Furthermore, lower open end 228 of exhaust air box 150 is positioned about second open end 189 of first exhaust duct 160.

With this construction, exhaust gases from lower oven cavity 46 are led through second exhaust duct 161, extension sleeve 236 and out a central region of exhaust outlet 155. As described above, these exhaust gases actually extend through main body portion 168 of first exhaust duct 161 and exhaust air box 150, generally through a duct within a duct arrangement. On the other hand, exhaust gases from upper oven cavity 45 flow through main body portion 168, around upstanding stack portion 209, and into exhaust air box 150. Within exhaust air box 150, the exhaust gases are permitted to exit exhaust outlet 155 on either side of extension sleeve 236. In accordance with the most preferred embodiment of the invention, upstanding stack portion 209 extends through cut-out 192 with a certain gap (not shown) therebetween. With this arrangement, a certain amount of ambient air within passageway 109 will be drawn into first exhaust duct 160. In this manner, hot exhaust gases flowing within first exhaust duct 160 will be diluted with cooler air prior to exiting at exhaust outlet 155.

In further accordance with the most preferred embodiment of the invention, it is desired to provide a certain degree of cooling of the exhaust gases emanating from lower oven cavity 46 as the exhaust gases are flowing through second exhaust duct 161. Therefore, with particular reference to FIG. 2, arranged within passageway 109 is an upstanding wall 280. As shown, upstanding wall 280 includes a lower portion 283 and an upper portion 285. Upper portion 285 is provided with rear openings defined by louvers 288. Upper portion 285 also includes an open upper end 290 which preferably terminates prior to first exhaust duct 160. Upper portion 285 of upstanding wall 280 generally follows the contour of upstanding stack portion 209, while being spaced rearwardly therefrom. In this manner, cool ambient air within passageway 109 can be directed by louvers 288 between upstanding stack portion 209 and upstanding wall 280. This cooler air will function to cool upstanding stack portion 209 and, correspondingly, the exhaust gases flowing through second exhaust duct 161, prior to flowing out of open upper end 290.

Figure 3:
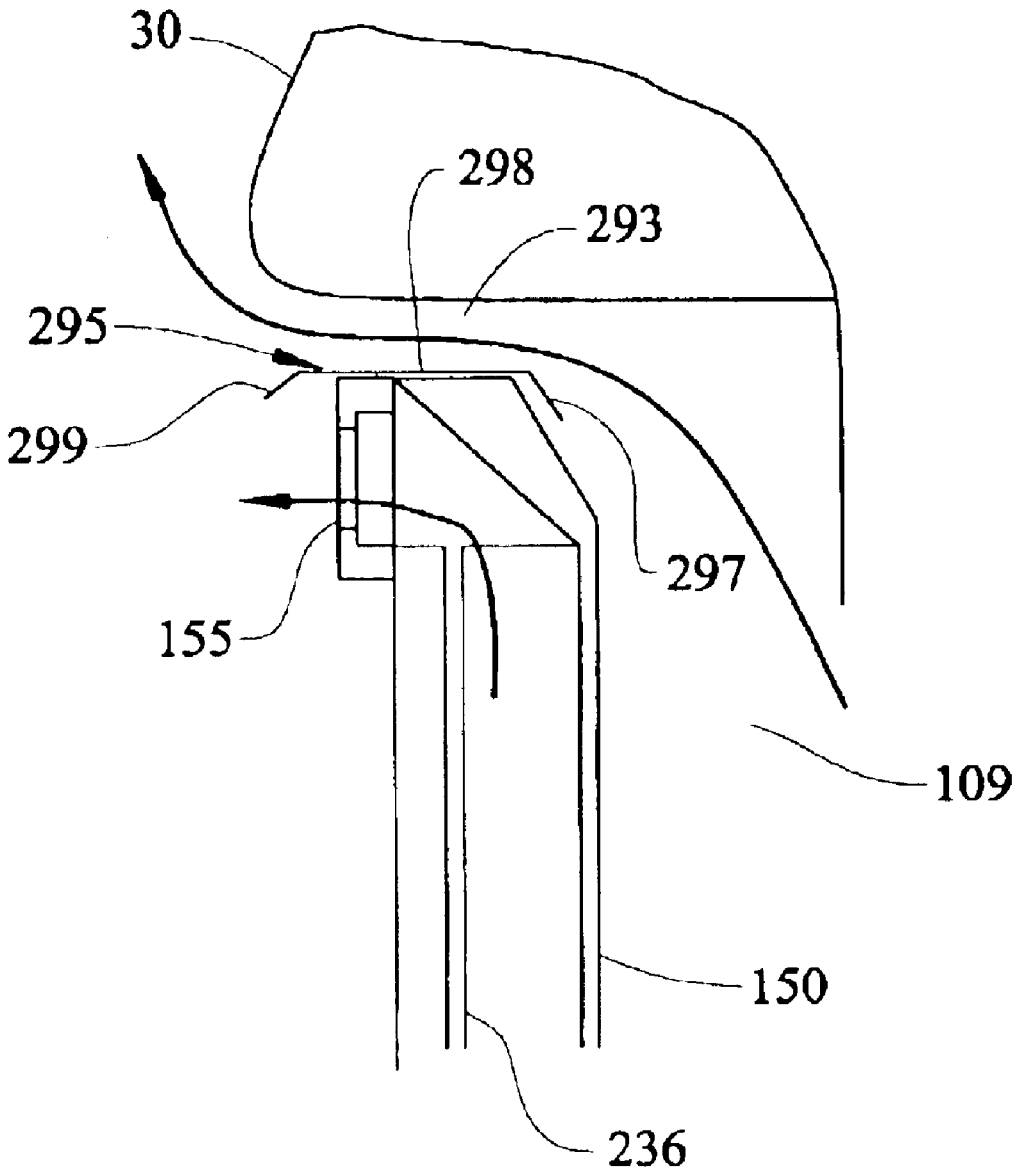
FIG. 3 is an enlarged, cross-sectional view of an exhaust outlet zone arranged below a control panel mounted on the cooking appliance of FIG. 2.

In accordance with the most preferred embodiment of the invention, a lowermost portion of control panel 30 is spaced above exhaust outlet 155 so as to define a passage 293 as clearly shown in FIG. 3. Passage 293 is provided to allow the ambient airflow from passageway 109 to exit cabinet 4. More specifically, above upstanding wall 280, the ambient airflow is directed between rear wall 9 and first exhaust duct 160, followed by exhaust air box 150, before exiting cabinet 4 through passage 293. As shown in FIG. 3, a diverter 295 is preferably mounted above exhaust air box 150. Diverter 295 includes a downward and rearward projecting portion 297, a planar mounting portion 298 and a downward and forward projecting portion 299. With this arrangement, the hotter exhaust gases leading from exhaust air box 150 are diverted. downwardly and forwardly by portion 299 of diverter 295 such that the exhaust gases will rise at a location spaced from control panel 30. On the other hand, the ambient airflow through passage 293 will flow closely adjacent control panel 30. In this manner, the cooling air through passage 293 will act as a barrier in order to protect the electrical components within control panel 30 from being subjected to the detrimental effects of the hotter exhaust gases.

Based on the above, it should be readily apparent that the exhaust system constructed in accordance with the present invention represents an extremely compact arrangement which is considered to be particularly advantageous in connection with a range having multiple ovens wherein space is at a premium. The exhaust system advantageously provides for cooling, as well as a certain amount of dilution, of the exhaust gases, while also controlling the dispersion of the exhaust gases, in an efficient and effective manner which protects electronic components of the appliance. In any event, although described with reference to a preferred embodiment of the invention, it should be readily understood that various changes and/or modifications can be made to the invention without departing from the spirit thereof. For instance, although the invention has been shown for use in a gas range, the principles of the present cooking system could be equally employed to other types of cooking appliances, including electric ranges. In addition, although an extension sleeve has been described for use in dividing the exhaust air box for the exhaust ducting of the upper and lower ovens, other structure could be employed for this purpose. For instance, the exhaust air box could be internally divided itself, or the upstanding stack portion of the exhaust duct for the lower oven could itself extend substantially through the exhaust air box. Furthermore, exhaust air box need not be a separate member but could be, for example, constituted by structure defined atop the first exhaust duct. Finally, while natural convection in the preferred mechanism by which the airflow moves through the system, an alternative mechanism, such as forced air provided by a fan, could be utilized. In general, the invention is only intended to be limited by the scope of the following claims.

We claim:

1. A cooking appliance comprising:

a cabinet including at least an upper rear portion, a back panel, opposing side panels and a top surface, said cabinet being adapted to rest upon a supporting surface;

a plurality of heating elements arranged about the top surface;

first and second oven cavities arranged within the cabinet, each of said first and second oven cavities including a rear wall spaced from the back panel such that a passageway is defined between the back panel and the respective rear walls;

an exhaust air box mounted within the cabinet and including an exhaust opening;

a first exhaust duct including a first end portion open to the first oven cavity and a second end portion opening into the exhaust air box, said first exhaust air duct being adapted to conduct a first exhaust airflow from the first oven cavity into the exhaust air box;

a second exhaust duct including a first end portion open to the second oven cavity, and an upstanding stack portion extending through the first exhaust duct and leading to the exhaust air box, said second exhaust air duct being adapted to conduct a second exhaust airflow from the second oven cavity into the exhaust air box, said exhaust air box being divided such that the second exhaust airflow is exhausted through a central portion of the exhaust air box and the first exhaust airflow is exhausted on either side of the central portion; and an extension sleeve connected to the upstanding stack portion of the second exhaust duct, said extension sleeve being arranged in the exhaust air box.

2. A cooking appliance comprising:

a cabinet including an upper rear portion, a back panel, opposing side panels and a top surface, said cabinet being adapted to rest upon a supporting surface;

a plurality of heating elements arranged about the top surface;

first and second oven cavities arranged within the cabinet, each of said first and second oven cavities including a rear wall spaced from the back panel such that a passageway is defined between the back panel and the respective rear walls;

an exhaust air box mounted within the cabinet and including an exhaust opening;

a first exhaust duct including a first end portion open to the first oven cavity and a second end portion opening into the exhaust air box, said first exhaust air duct being adapted to conduct a first exhaust airflow from the first oven cavity into the exhaust air box; and a second exhaust duct including a first end portion open to the second oven cavity, and an upstanding stack portion extending through the first exhaust duct and leading to the exhaust air box, said second exhaust air duct being adapted to conduct a second exhaust airflow from the second oven cavity into the exhaust air box.

3. The cooking appliance according to claim 2, further comprising:

a control panel arranged at the upper rear portion of the cabinet, above the exhaust opening; and a diverter member mounted between the exhaust opening and the control panel for directing the first and second exhaust airflows away from the control panel.

4. The cooking appliance according to claim 2, further comprising:

a control panel arranged at the upper rear portion of the cabinet, above the exhaust opening; and a passage established between the control panel and the exhaust opening, said passageway opening to the passage, wherein a flow of cooling air is directed from within the cabinet to the passage between the control panel and the exhaust opening.

5. The cooking appliance according to claim 4, further comprising:

a diverter member mounted between the exhaust opening and the control panel for directing the first and second exhaust airflows away from the control panel.

6. The cooking appliance according to claim 2, wherein the first exhaust duct includes a bottom wall formed with a cut-out section, said second exhaust duct extending into the first exhaust duct through the cut-out section.

7. The cooking appliance according to claim 2, further comprising:

an extension sleeve connected to the upstanding stack portion of the second exhaust duct, said extension sleeve being arranged in the exhaust air box.

8. The cooking appliance according to claim 7, wherein the extension sleeve is arranged in a central portion of the exhaust air box such that the second exhaust airflow is exhausted through a central portion of the exhaust air box and the first exhaust airflow is exhausted on either side of the central portion.

9. The cooking appliance according to claim 2, further comprising:

means for cooling at least one of the first and second exhaust airflows prior to the exhaust opening.

10. The cooking appliance according to claim 9, further comprising:

means for diluting at least one of the first and second exhaust airflows prior to the exhaust opening.

11. A cooking appliance comprising:

a cabinet including at least an upper rear portion, a back panel, opposing side panels and a top surface, said cabinet being adapted to rest upon a supporting surface;

a plurality of heating elements arranged about the top surface;

first and second oven cavities arranged within the cabinet, each of said first and second oven cavities including a rear wall spaced from the back panel such that a passageway is defined between the back panel and the respective rear walls;

an exhaust air box mounted within the cabinet and including an exhaust opening;

a first exhaust duct including a first end portion open to the first oven cavity and a second end portion opening into the exhaust air box, said first exhaust air duct being adapted to conduct a first exhaust airflow from the first oven cavity into the exhaust air box;

a second exhaust duct including a first end portion open to the second oven cavity, and an upstanding stack portion leading to the exhaust air box, said second exhaust air duct being adapted to conduct a second exhaust airflow from the second oven cavity into the exhaust air box; and an extension sleeve connected to the upstanding stack portion of the second exhaust duct, said extension sleeve being arranged in the exhaust air box.

12. The cooking appliance according to claim 11, wherein the extension sleeve is arranged in a central portion of the exhaust air box such that the second exhaust airflow is exhausted through a central portion of the exhaust air box and the first exhaust airflow is exhausted on either side of the central portion.

13. The cooking appliance according to claim 11, wherein the second exhaust duct extends through the first exhaust duct.

14. The cooking appliance according to claim 13, wherein the first exhaust duct includes a bottom wall formed with a cut-out section, said second exhaust duct extending into the first exhaust duct through the cut-out section.

15. The cooking appliance according to claim 11, further comprising:

a control panel arranged at the upper rear portion of the cabinet, above the exhaust opening; and a diverter member mounted between the exhaust opening and the control panel for directing the first and second exhaust airflows away from the control panel.

16. The cooking appliance according to claim 11, further comprising:

a control panel arranged at the upper rear portion of the cabinet, above the exhaust opening; and a passage established between the control panel and the exhaust opening, said passageway opening to the passage, wherein a flow of cooling air is directed from within the cabinet to the passage between the control panel and the exhaust opening.

17. The cooking appliance according to claim 16, further comprising:

a diverter member mounted between the exhaust opening and the control panel for directing the first and second exhaust airflows away from the control panel.

18. The cooking appliance according to claim 11, further comprising:

means for cooling at least one of the first and second exhaust airflows prior to the exhaust opening.

19. The cooking appliance according to claim 11, further comprising:

means for diluting at least one of the first and second exhaust airflows prior to the exhaust opening.

20. A cooking appliance comprising:

a cabinet including at least an upper rear portion, a back panel, opposing side panels and a top surface, said cabinet being adapted to rest upon a supporting surface;

a plurality of heating elements arranged about the top surface;

first and second oven cavities arranged within the cabinet, each of said first and second oven cavities including a rear wall spaced from the back panel such that a passageway is defined between the back panel and the respective rear walls;

an exhaust air box mounted within the cabinet and including an exhaust opening;

a first exhaust duct including a first end portion open to the first oven cavity and a second end portion opening into the exhaust air box, said first exhaust air duct being adapted to conduct a first exhaust airflow from the first oven cavity into the exhaust air box; and a second exhaust duct including a first end portion open to the second oven cavity, and an upstanding stack portion leading to the exhaust air box, said second exhaust air duct being adapted to conduct a second exhaust airflow from the second oven cavity into the exhaust air box, said exhaust air box being divided such that the second exhaust airflow is exhausted through a central portion of the exhaust air box and the first exhaust airflow is exhausted on either side of the central portion.

21. The cooking appliance according to claim 20, further comprising:

an extension sleeve connected to the upstanding stack portion of the second exhaust duct, said extension sleeve being centrally arranged in the exhaust air box such that the second exhaust airflow is exhausted through a central portion of the exhaust air box and the first exhaust airflow is exhausted on either side of the central portion.

22. The cooking appliance according to claim 20, wherein the second exhaust duct extends through the first exhaust duct.

23. The cooking appliance according to claim 22, wherein the first exhaust duct includes a bottom wall formed with a cut-out section, said second exhaust duct extending into the first exhaust duct through the cutout section.

24. The cooking appliance according to claim 20, further comprising:

a control panel arranged at the upper rear portion of the cabinet, above the exhaust opening; and a passage established between the control panel and the exhaust opening, said passageway opening to the passage, wherein a flow of cooling air is directed from within the cabinet to the passage between the control panel and the exhaust opening.

25. The cooking appliance according to claim 24, further comprising:

a diverter member mounted between the exhaust opening and the control panel for directing the first and second exhaust airflows away from the control panel.

26. The cooking appliance according to claim 20, further comprising:

means for cooling at least one of the first and second exhaust airflows prior to the exhaust opening.

27. The cooking appliance according to claim 20, further comprising:

means for diluting at least one of the first and second exhaust airflows prior to the exhaust opening.

28. A method of exhausting cooking byproducts in a cooking appliance having a cabinet, including an upper rear portion, a back panel, a top surface, a plurality of spaced heating elements arranged about the top surface, and first and second oven cavities arranged within the cabinet, said method comprising:

directing a first exhaust airflow from the first oven cavity through a first duct opening into an exhaust air box having an associated exhaust opening; and directing a second exhaust airflow from the second oven cavity through a second duct opening into the exhaust air box, wherein the first and second exhaust airflows are divided so as to be exhausted through distinct sections of the exhaust air box.

29. The method of claim 28, further comprising:

diverting each of the first and second airflows away from a control panel provided on the upper rear portion of the cooking appliance.

30. The method of claim 28, wherein the second exhaust airflow is directed to the exhaust air box through the second duct which extends through the first duct.

31. The method of claim 30, further comprising:

directing the second exhaust airflow into the exhaust air box through an extension sleeve.

32. The method of claim 28, further comprising:

convection cooling at least one of the first and second exhaust airflows prior to the exhaust opening.

33. The method of claim 28, further comprising:

diluting at least one of the first and second exhaust airflows prior to the exhaust opening.

34. The method of claim 28, further comprising:

directing a flow of cooling air within a passageway defined between rear walls of the first and second oven cavities and the back panel of the cabinet, with the flow of cooling air being directed from within the cabinet to a passage between the control panel and the exhaust opening in order to establish a barrier between the control panel and the first and second exhaust airflows.

* * * * *